US008893589B2

(12) United States Patent
Kibby

(10) Patent No.: US 8,893,589 B2
(45) Date of Patent: Nov. 25, 2014

(54) ENHANCED RATCHET

(76) Inventor: Ivan Kibby, Dallas, TX (US)

( * ) Notice: Subject to any disclaimer, the term of this patent is extended or adjusted under 35 U.S.C. 154(b) by 529 days.

(21) Appl. No.: 12/793,522

(22) Filed: Jun. 3, 2010

(65) Prior Publication Data

US 2011/0296959 A1 Dec. 8, 2011

(51) Int. Cl.
*B25B 13/46* (2006.01)

(52) U.S. Cl.
CPC ..... *B25B 13/463* (2013.01); *B25B 13/468* (2013.01)
USPC ..... 81/62; 81/63.1

(58) Field of Classification Search
USPC ..... 81/60–63.2
See application file for complete search history.

(56) References Cited

U.S. PATENT DOCUMENTS

| | | | | | |
|---|---|---|---|---|---|
| 349,007 | A * | 9/1886 | Sinclair | 81/62 |
| 1,177,764 | A * | 4/1916 | Dodge | 81/62 |
| 1,334,674 | A * | 3/1920 | Pannitti, Jr. | 81/58.3 |
| 1,913,669 | A * | 6/1933 | Heald | 81/62 |
| 2,201,705 | A * | 5/1940 | Stone | 192/43.2 |
| 2,590,387 | A * | 3/1952 | Dodge | 81/62 |
| 3,598,001 | A * | 8/1971 | Thomasian | 81/63.1 |
| 4,003,275 | A * | 1/1977 | Smith | 81/57.29 |
| 4,406,183 | A * | 9/1983 | Wix | 81/57.29 |
| 4,561,329 | A * | 12/1985 | Lack | 81/62 |
| 4,602,534 | A | 7/1986 | Moetteli | |
| 4,711,145 | A | 12/1987 | Inoue | |
| 4,722,252 | A * | 2/1988 | Fulcher et al. | 81/57.39 |
| 5,626,062 | A | 5/1997 | Colvin | |
| 7,121,167 | B1 * | 10/2006 | Miner | 81/57.39 |

* cited by examiner

*Primary Examiner* — Alicia Torres
(74) *Attorney, Agent, or Firm* — Dentons US LLP

(57) ABSTRACT

A ratchet including a handle and a head connected to the handle. The ratchet further includes a rotating drum rotationally mounted within the head. A top edge of the rotating drum is open and a bottom edge of the rotating drum is closed by a surface. A rotating head extends from the surface of the rotating drum. One or more pawls within the head interact with the rotating drum to drive the rotating drum and rotating head in a first direction or a second direction in response to a force being applied to the handle. The ratchet includes a direction toggle connected to the one or more pawls being operable to engage the one or more pawls for selecting to drive the rotary head of the rotating drum in the first direction or the second direction corresponding to a first position or a second position of the direction toggle, respectively.

21 Claims, 5 Drawing Sheets

104
106

100
102
104
106
108
110
112
114

ENHANCED RATCHET

BACKGROUND

Mechanical design and manufacturing has become more and more efficient in recent years. Electronic design tools, such as computer added drafting and design programs have allowed engineers and designers to more closely position mechanical elements while simultaneously retaining or improving on their existing functionality. The increased efficiency means that it is harder and harder to access individual parts, fasteners, and other mechanical elements. For example, in new electric vehicles, parts are so closely positioned that it is difficult for mechanics or users to access bolts or other securing parts to perform necessary repairs. As a result, mechanical tools have not kept pace with computer-aided design tools.

SUMMARY

One embodiment includes a ratchet including a handle and a head connected to the handle. The ratchet further may include a rotating drum rotationally mounted within the head. A top edge of the drum may be open and a bottom edge of the drum is closed by a surface. A rotating head may extend from the surface of the rotating drum. One or more pawls within the head may interact with the rotating drum to drive the rotating drum and rotating head in a first direction or a second direction in response to a force being applied to the handle. The ratchet may also include a direction toggle connected to the one or more pawls being operable to engage the one or more pawls for selecting to drive the rotary head of the drum in the first direction or the second direction corresponding to a first position or a second position of the direction toggle, respectively.

Another embodiment includes an enhanced ratchet. The enhanced ratchet may include a handle and a head connected to the handle. The enhanced ratchet may also include a rotating drum rotationally mounted with the head. An outer surface of the rotating drum may be covered by teeth, a top edge of the rotating drum may be open, and a bottom edge of the rotating drum may be closed by a surface. A rotating head may be integrated with the surface of the rotating drum. A socket may be substantially seated in the rotating drum when attached to the rotating head. The enhanced ratchet may also include a direction toggle accessible at an end of the handle. The direction toggle may be operably connected to the one or more pawls through a linkage extending through the handle. The one or more pawls may be operable to engage the teeth for driving the rotary head of the rotating drum in a first mode, a second mode, or a third mode, corresponding to a first position, second position, and third position of the direction toggle.

Yet another embodiment includes a method for utilizing an enhanced ratchet. A socket may be received within a rotating drum of the enhanced ratchet. The socket may be secured to a rotating head attached to the rotating drum. The socket may be seated substantially within a ratchet head of the enhanced ratchet rotationally securing the rotating drum. Positioning of a direction toggle corresponding to one of three modes is received. The first mode may correspond to a clockwise driving force and a counter-clockwise ratcheting direction, the second mode may correspond to a counter-clockwise driving force and a clockwise ratcheting direction, and the third mode may correspond to a clockwise and counterclockwise driving force. A driving force is applied to the socket in response to receiving the positioning of the direction toggle in one of the three modes.

BRIEF DESCRIPTION OF THE DRAWINGS

Illustrative embodiments of the present invention are described in detail below with reference to the attached drawing figures, which are incorporated by reference herein and wherein.

DETAILED DESCRIPTION OF THE DRAWINGS

Illustrative embodiments of the present invention provide an enhanced ratchet. The enhanced ratchet is one embodiment of a socket wrench. The enhance ratchet is a type of tightening tool that uses removable sockets to fit many different sizes of fittings and fasteners, such as nuts and bolts. The enhanced ratchet provides all of the advantages of traditional ratchets as well as the advantages of female or inverted ratchets. The enhanced ratchet may be particularly useful in conditions with limited working space for a traditional ratchet and socket. The enhanced ratchet or "ratchet" allows the socket to be seated within the ratchet during use of the tool to reduce the footprint or width of the tool when accessing tight spaces.

Figures 1, 1A:
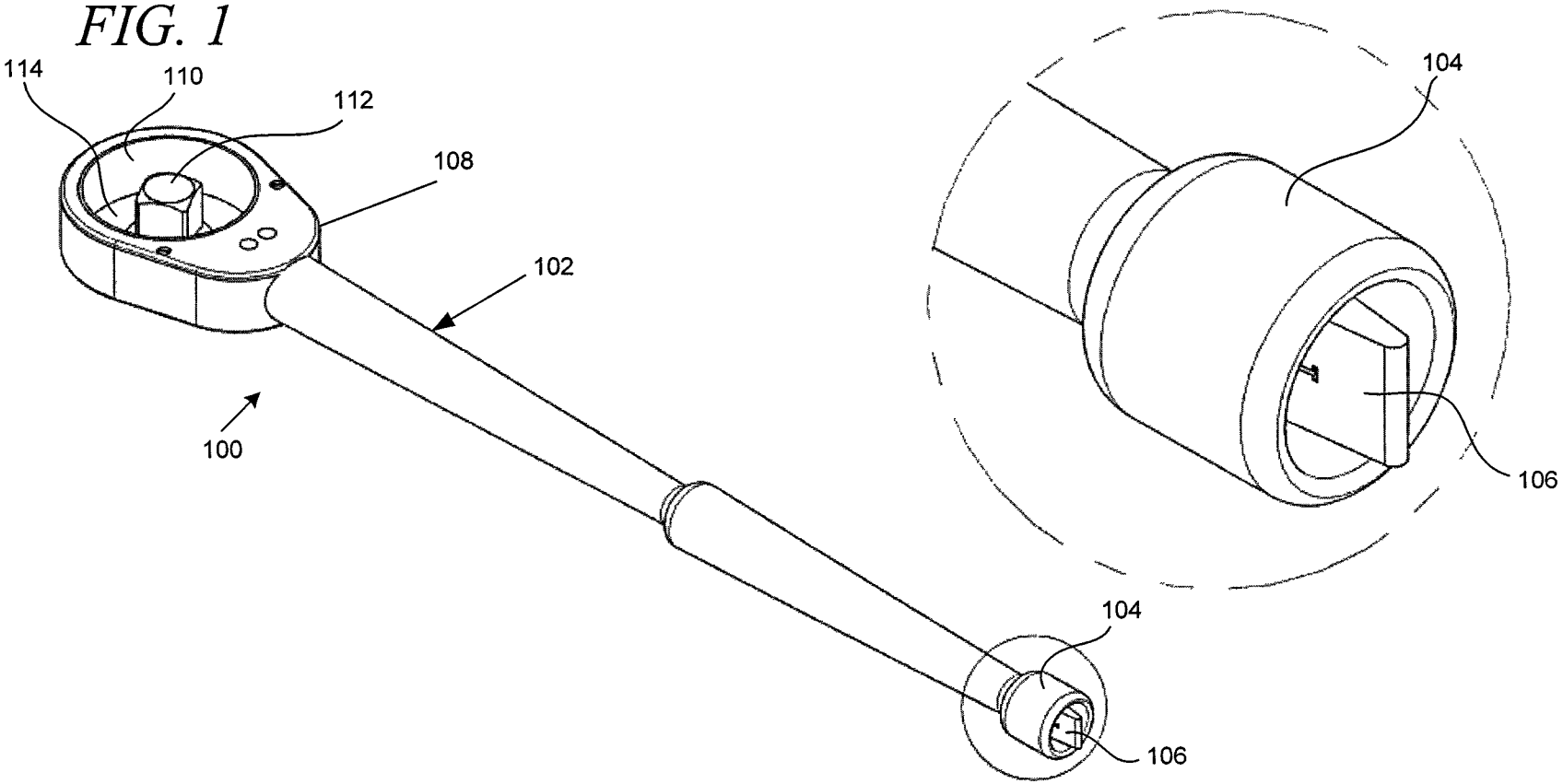
FIG. 1 is a perspective view of a ratchet in accordance with an illustrative embodiment.
FIG. 1A is a expanded perspective view of a direction toggle within a handle of the ratchet of FIG. 1 in accordance with an illustrative embodiment.
Figure 2:
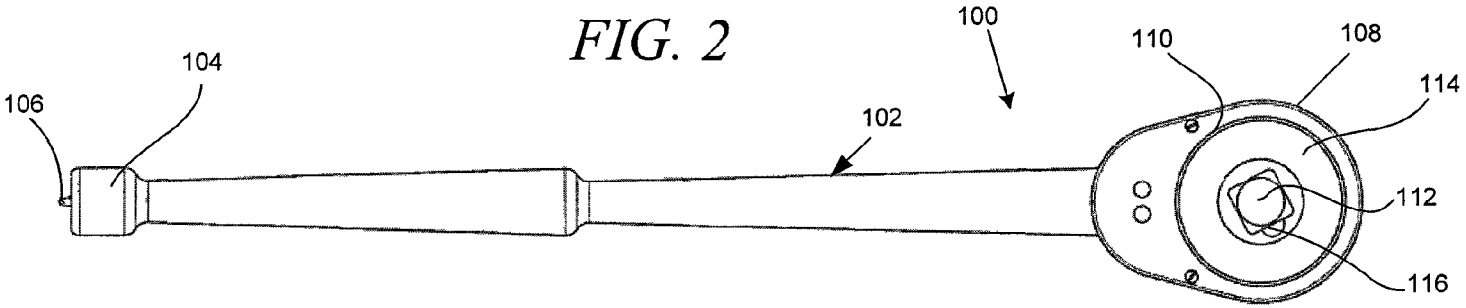
FIG. 2 is a top view of the ratchet of FIG. 1.

Referring now to FIGS. 1 and 1A, showing a ratchet 100 in accordance with an illustrative embodiment. The ratchet 100 may be provided in any number of sizes and configurations based on the type of work and sockets utilized by a user. In one embodiment, the ratchet 100 and a substantial portion of the elements of the ratchet 100 may be formed of stainless steel. Other materials commonly utilized for high grade tools may also be utilized, including titanium, aluminum, carbon fiber, reinforced plastic or other similar materials. The ratchet 100 may include a handle 102. The handle 102 may be utilized to apply a force, pressure, or torque to the ratchet 100. The handle 102 may include differently sized portions, embossing, or a grip allowing the user or a tool to better hold the handle 102 while using the ratchet 100.

The handle 102 has an end 104 from which extends a direction toggle 106. The handle 102 may include a first end that attaches to or is integrated with a ratchet head 108 and a second end 104 that houses the direction toggle 106. The direction toggle 106 is a selection element operable to select a ratcheting direction of the ratchet 100. In one embodiment, the direction toggle 106 is integrated with the handle 102 as shown. In another embodiment, the direction toggle 106 may be integrated with or attached to the ratchet head 108 or handle 102, as is known in the art.

In one embodiment, the direction toggle 106 may have two or three different modes. The three modes may correspond to the position of the direction toggle 106 as selected by user. For example, the user may position the direction toggle 106 in one of three positions utilizing a finger, thumb or other applied force to the direction toggle 106. A first position of the direction toggle 106 may correspond to a first mode that allows a socket and corresponding fastener attached to the ratchet 100 to be driven in a clockwise direction and ratchet freely back in the counter-clockwise direction. A second position of the direction toggle 106 corresponding to a second mode of the ratchet 100, may allow the socket and fastener to be driven in a counter-clockwise direction and ratchet freely back in the counter-clockwise direction. In one embodiment, the direction toggle 106 may also include a third position that allows the socket and the fastener to be driven by the ratchet 100 in both a clockwise and counter-clockwise direction based on the force applied to the handle 102 by the user or equipment. As is described in additional figures, the direction toggle 106 communicates with one or more pawls in the ratchet head 108 to select a driving direction and/or a free spinning direction of the ratchet 100.

The ratchet head 108 includes a rotating drum 110 that is rotationally attached to the ratchet head 108. As shown, the rotating drum 110 may include an opening or receptacle for receiving a standard female socket. Although referred to as a socket, the socket may refer to any tool attachable to the ratchet head 108 for securing or removing a fastener or otherwise acting as a mechanical tool or advantage. The socket may be attached to or mounted on a rotating head 112. The rotating head 112 is a protrusion extending from the rotating drum 110. The rotating head 112 may drive the action of the socket during utilization of the ratchet 100. The size and shape of the rotating head 112 may vary based on the socket or sockets being utilized. The ratchet 100 and ratchet head 112 may be formed from a single or multiple elements. In one embodiment, the rotating head 112 may be forged or molded from the same material as the rotating drum 110. Alternatively, the rotating head 112 may be welded or otherwise affixed to the ratchet head 108 for increased stability and durability. In another embodiment, the rotating head 112 may be interchangeable with a number of different sizes or shapes that attach to the ratchet head 108.

As shown, the rotating drum 110 rotates within the ratchet head 108 in a clockwise or counter-clockwise direction about an axis extending from the center of the rotating head 112. The rotating drum 110 is open at a front end and sealed at a back end by a surface 114. The surface 114 allows the rotating head 112 to be attached to the rotating drum 110 supporting motion of an attached socket. As described, the diameter of the rotating drum 110 may vary from ratchet to ratchet based on the diameter of sockets utilized with the ratchet 100. For example, the rotating head 112 may be ⅜" to fit common socket sizes.

In one embodiment, the rotating drum 110 including the rotating head 112 and surface 114 is magnetized. The magnetization may further facilitate attaching and retaining the socket on the rotating head 112.

The recessed nature of the rotating drum 110 allows the ratchet head 108 and attached socket extending from the ratchet 100 to have a reduced width or footprint. The reduced width allows the ratchet 100 and attached socket to have a reduced footprint, which may be particularly important when working in small or tight spaces. The width of the functional ratchet 100 is reduced compared to standard ratchets as the socket is positioned or substantially seated within the recessed portion of the rotating drum 110 to the rotating head 112, thereby significantly reducing the width of the overall tool (ratchet 100 and attached socket) for working in tight spaces. Additionally, the configuration of the ratchet 100 may allow users to buy a single ratchet rather than multiple male and female ratchets.

Referring now to FIGS. 2, 3, 3A, and 3B, that further illustrate a configuration of the ratchet 100. The ratchet 100 may include a release 116. In one embodiment, the release 116 may be a bearing within the rotating head 112 that is operable to extend from or recede back into the rotating head 112 in response to user selection of a fastener. The fastener may be a mechanical element, such as a button commonly utilized with ratchets to engage or release a socket. In another embodiment, the fastener may be integrated with the direction toggle 106. For example, the pressure applied by a user to the fastener in a direction against the handle 102 may activate the release 116 for attaching or detaching the socket from the rotating head 112. Any number of other releasers and fasteners known in the art may also be utilized.

In one embodiment, the rotating head 112 may rely on friction, based on the size tolerances of the rotating head 112 (or release 116) and socket, to keep the tool functioning properly. The rotating drum 110 rotates on a bearing assembly (not shown) positioned at the bottom of the ratchet head 108. The bearing assembly may include multiple bearings that support the rotating drum 110 and allow the rotating drum 110 to rotate as needed about an axis extending from the rotating head 112 and perpendicular to a plane of the handle 102 and the ratchet head 108.

In one embodiment, the rotating drum 110 may include numerous teeth about the periphery of the rotating drum 110. The teeth 118 may allow a ratcheting mechanism to select a driving direction and a ratcheting direction, or free spinning direction of the ratchet 100.

In one embodiment, the ratchet mechanism may include pawls 119, a spring 120, extenders 121, a pawl linkage 122, a mount 124, and pins 126, as shown and herein described. Additionally, other ratcheting mechanisms as are known in the art may be utilized to select a driving and ratcheting direction of the rotating drum 110 and the rotating head 112. The ratcheting mechanism may be activated through a linkage cavity 128 housing a linkage 130 that allows a user to select the driving direction using the direction toggle 106 positioned within a selection cavity 132 of the end 104.

Figure 3:
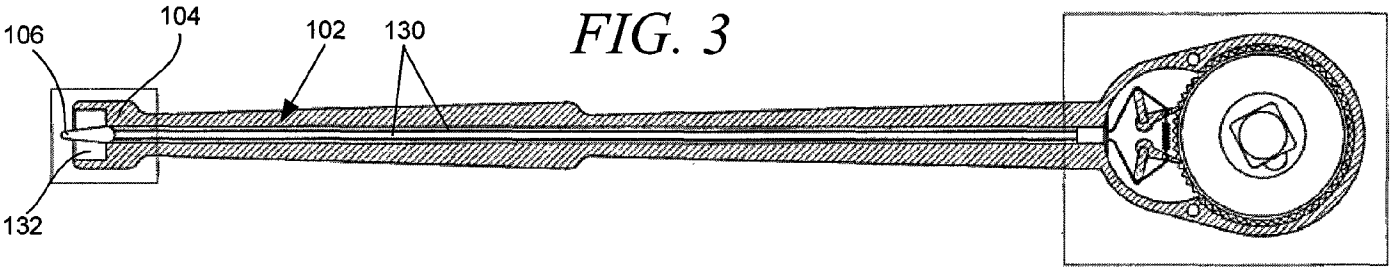
FIG. 3 is a cut-away view of the ratchet of FIG. 3.
Figure 3A:
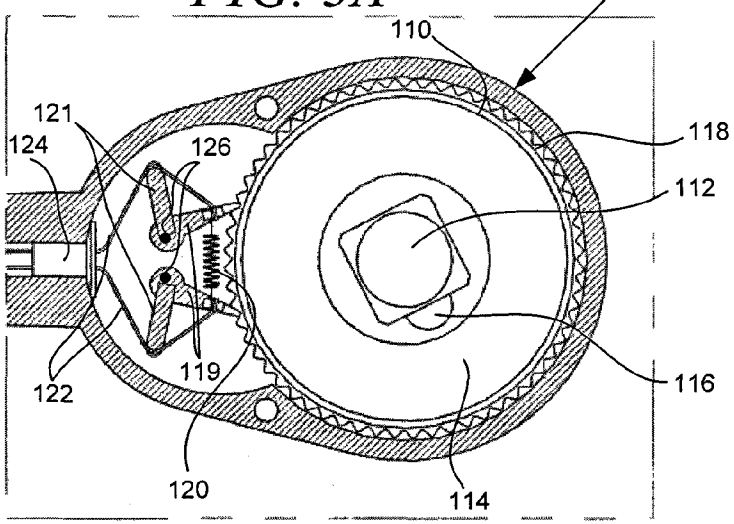
FIG. 3A is a cut-away view of the ratchet head of FIG. 3.
Figure 3B:
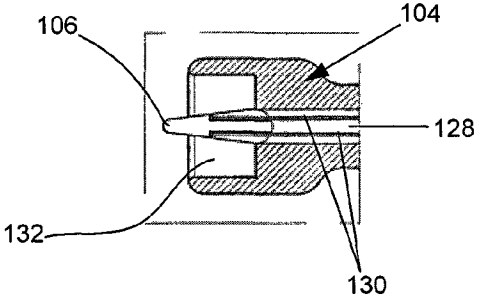
FIG. 3B is a cut-away view of the direction toggle of the ratchet of FIG. 3.

The pawls 119 may be positioned and engaged based on a position of the direction toggle 106 as communicated through the linkage 130 and pawl linkage 122. In one embodiment, the direction toggle 106 may be positioned so that both of the pawls 119 are engaged, for driving the rotating drum 110 in either direction based on the application of a force. As shown in the embodiment of FIG. 3, if the direction toggle 106 is positioned up, the bottom linkage 130 is retracted, thereby retracting the bottom-most pawl and engaging the upper pawl allowing the rotating head 112 and rotating drum 110 to be driven in a clockwise direction and freely spin in a counter-clockwise direction when looking directly at the rotating head 112. In a second position with the direction toggle 106 positioned down within the selection cavity, the top-most portion of the linkage is retracted further retracting the top-most pawl and engaging the bottom pawl, allowing the rotating drum 110 and rotating head to be driven in a clockwise direction and freely spin in a clockwise direction when looking directly at the rotating head 112.

The pawls 119 may be rotationally or pivotally attached to the ratchet head 108 utilizing the pins 126. In other embodiments, the pins may be replaced by rivets, screws, or other elements that allow the pawls 119 to be rotationally attached to the ratchet head 108. The spring 120 or other biasing elements may be utilized to bias the pawls 119 in a first direction, second direction, or the default position shown. The spring 120 may allow the direction toggle 106 to remain in a selected position without moving the ratcheting mechanism when a user is utilizing the ratchet 100. The pawls 119 are positioned to allow the rotating drum 110 and corresponding teeth 118 to spin in one direction and engage in another. For example, as described, when the upper-most of the pawls 119 is engaged, the pawls 119 impinge upon the teeth 118 to drive the rotating drum 110 and rotating head 112 in response to a force applied to the handle 102.

The extenders 121 are integrated with, or attached to the pawls 119, for directionally applying a force from the pawl linkage 122. As shown, the pawl linkage 122, extenders 121, and pawls 119 may be provided in pairs for selecting the first direction, second direction, or dual-direction driving modes of the ratchet 100. In one embodiment, the linkage 130 and pawl linkage 122 may be miniaturized cable or wire that communicates the forces rotationally applied to the direction toggle 106 to engage and disengage the respective pawls 119 based on the motion of the linkage parallel to the handle 102. The directional toggle 106 may be a lever that is switched, a knob, dial, or other mechanical selection element for engaging the linkage 130 to positions the pawls 119. In another embodiment, the linkage 130 and pawl linkage 122 represent miniaturized steel rods extending through the linkage cavity 128 into a space or cavity defined by the ratchet head 108. The mount 124 may further secure the linkage 130 and pawl linkage 122 during motion of the direction toggle 106. For example, the mount 124 may include apertures for each portion of the linkage 130 to slide therethrough during motion of the direction toggle 106 between the three specified positions, corresponding to the three modes.

The socket, when placed within the rotating drum 110, is supported on a bottom-most portion by the surface 114 and is directionally driven by the rotating head 112 based on a force or torque applied to the handle 102. The rotating head 112 provides the rotational torque to the socket and the surface 114 may provide support in a direction against a fastener and socket.

Figure 4:
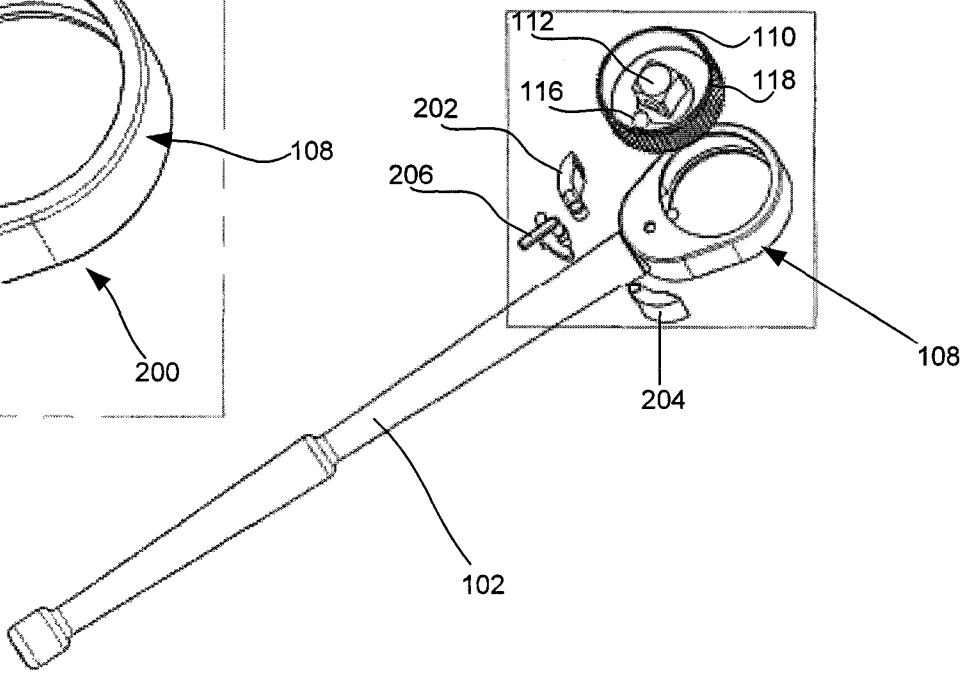
FIG. 4 is an exploded view of a ratchet in accordance with an illustrative embodiment.
Figure 4A:
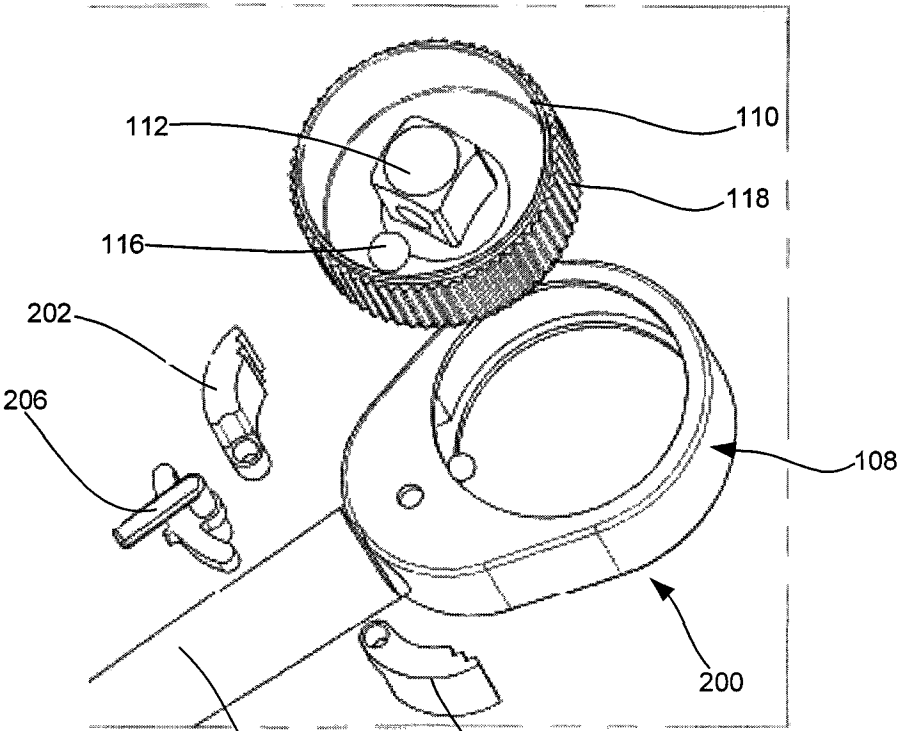
FIG. 4A is an expanded view of the ratchet of FIG. 4.

Referring now to FIGS. 4 and 4A, an exploded view of another embodiment of the ratchet 200 is shown in accordance with an illustrative embodiment. In particular, the ratchet 200 may include pawls 202 and 204, and a toggle 206. The pawls 202 and 204 may be utilized to mechanically interface with the rotating drum 110 to select both a driving and ratcheting direction of the rotating drum 110 and corresponding rotating head 112. As shown, the pawls 202 and 204 may be rotationally attached to the ratchet head 108. The toggle 206 may be rotationally attached to the pawls 202 and 204 through respective apertures in the ratchet head 108 and pawls 202 and 204 allowing each of the respective components to pivot in response to a user applied pressure.

For example, in response to pressing the bottom of the toggle 206 in a left direction, the pawl 202 may be engaged for driving the rotating drum 110 and rotating head 112 in a clockwise direction and ratcheting in a counter-clockwise direction. Similarly, when the pawl 202 is engaged, the pawl 204 is disengaged. In a second position, when the toggle 206 is positioned to the right, the pawl 204 engages with the teeth 118 to drive the rotating drum 110 and the rotating head 112 in a counter-clockwise direction, and to ratchet in a clockwise direction. In a default position parallel with the handle 102, both the pawls 202 and 204 may be engaged for driving the rotating drum 110 and rotating head 112 in the clockwise or counter-clockwise direction. The pawls 202 and 204 may also be biased utilizing any number of biasing elements, such as springs, elastomers or other similar elements to remain in any of the described positions while using the ratchet 200 and an attached socket.

Figure 5:
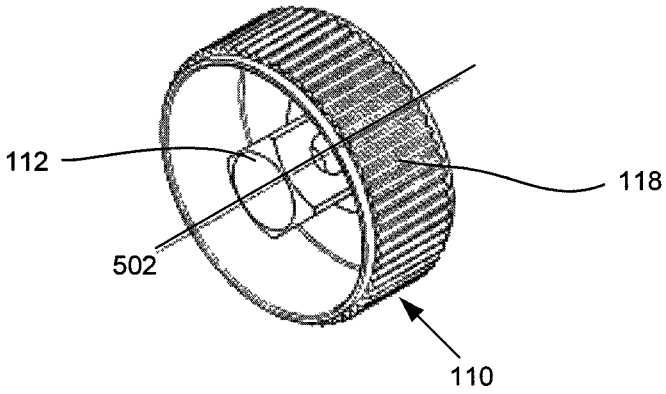
FIG. 5 is a perspective view of the rotating drum in accordance with an illustrative embodiment.
Figure 6:
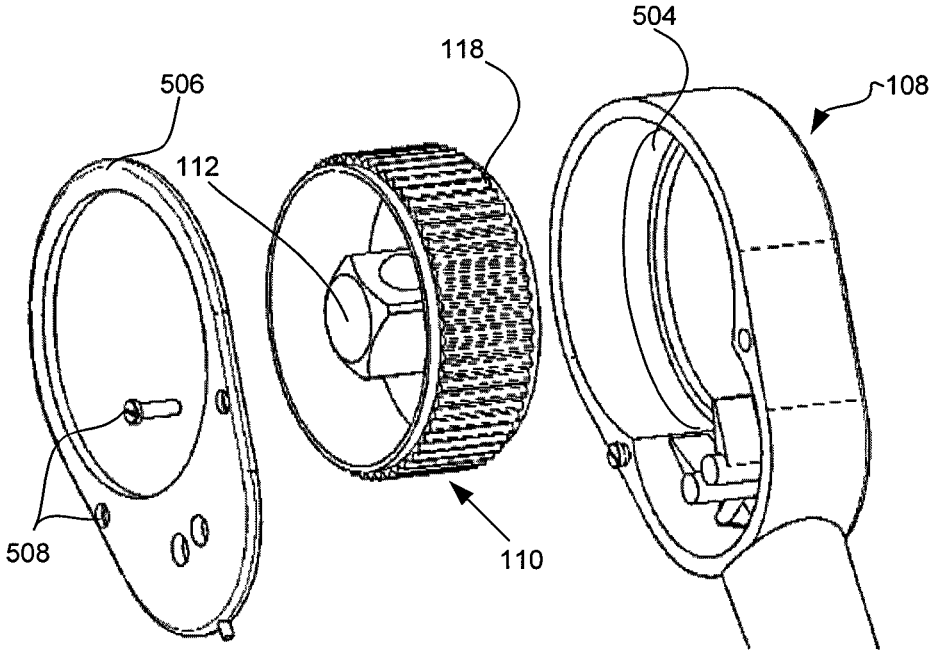
FIG. 6 is a partial exploded view of the ratchet in accordance with an illustrative embodiment.

FIGS. 5 and 6 further illustrate the ratchet 200 of FIG. 4. As previously described, the rotating drum 110 rotates about an axis 502 extending through the rotating head 112 as shown. In one embodiment, the rotating drum 110 may be attached to, or set on, a bearing assembly 504. The bearing assembly 504 allows the smooth rotational motion of the rotating head 112 within the ratchet head 108. The bearing assembly 504 may also be a hub integrating the ratchet head 108 and the rotating drum 110 for the rotational motion needed to drive a socket in a clockwise or counter-clockwise direction when applied to a fastener. The ratchet head 108 may also include a cover 506 for sealing the rotating drum 110 within the ratchet head 108. The cover 506 may be attached to the ratchet head 108 utilizing any number of screws 508 or other fastening elements, such as pins, rivets and so forth. An additional bearing assembly, reduced friction source, or other element facilitating and enhancing the rotation of the rotating drum 110 may be secured between the cover 506 and the rotating drum 110 or otherwise within the ratchet head 108.

The teeth 118 may extend vertically up the sides of the rotating drum 110 about the periphery of the rotating drum 110. The separation and size of the teeth 118 may vary based on the desired resolution of the ratcheting motion. Additional shaped, sized, or configured external mechanical elements may be integrated with or attached to the rotating drum 110. In another embodiment, the rotating drum 110 may be substantially thinner than the ratchet head 108 for accommodating sockets of different sizes and shapes.

In another embodiment, the rotating drum 110 or all or portions of the described embodiments may be utilized in other ratcheting tools, such as screw drivers, pneumatic ratchets, or other similar manual, pneumatic, electric, or other power tools. The rotating drum 110 and rotating head 112 may be integrated in any number of tools in order to more efficiently use space.

Figure 7:
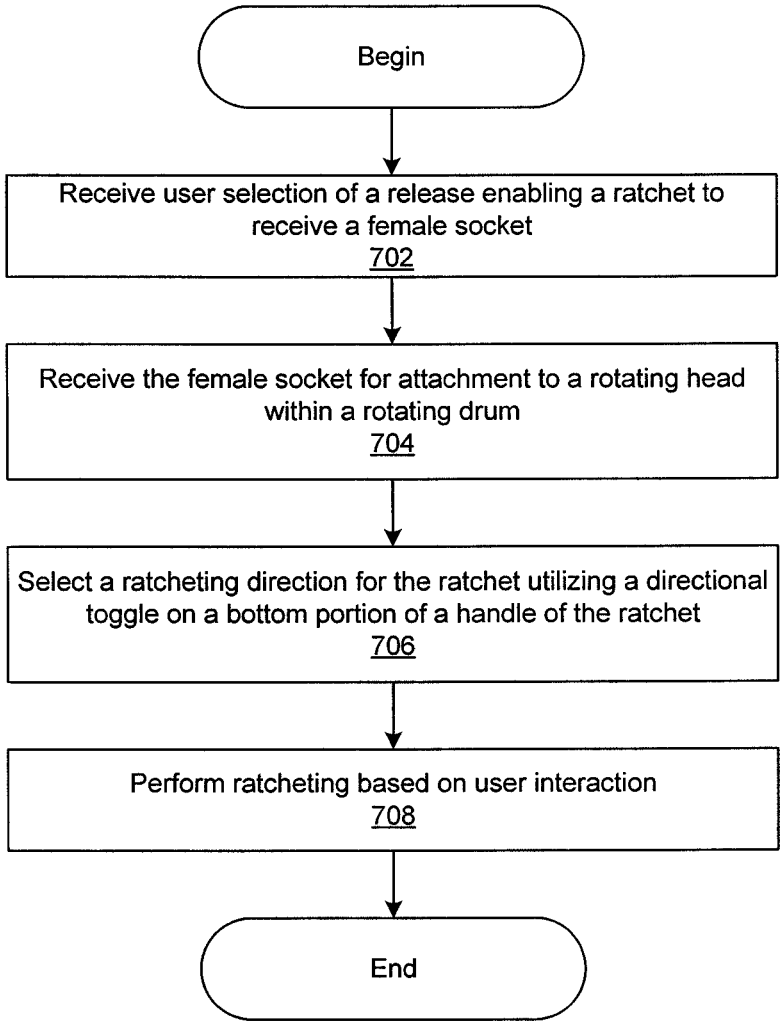
FIG. 7 is a flowchart of a process for utilizing a ratchet in accordance with an illustrative embodiment.

FIG. 7 is a flowchart of a process for utilizing a ratchet in accordance with an illustrative embodiment. The process of FIG. 7 may implemented by a user utilizing an enhanced ratchet as herein described.

The process may begin by receiving a user selection of a release enabling a ratchet to receive a female socket (step 702). The user selection may be activation of a button or fastener mechanically linked to the release that allows the socket to be attached or detached to the rotating head of the socket. In another embodiment, the release may be integrated with the direction toggle, thereby allowing a user to attach the socket based on user feedback provided through an end of the ratchet preventing inadvertent or accidental release of the socket.

Next, the ratchet receives the female socket for attachment to a rotating head within a rotating drum (step 704). The ratchet, as described in the various embodiments, allows the socket to be inserted within the recessed portion of the rotating drum, thereby decreasing the width or footprint size of the ratchet and socket when utilized to attach or detach a fastener. As a result, the user may be able to use the ratchet in spaces that would be inconvenient or impossible to use a standard ratchet utilizing a male connector and female sockets.

Next, the user selects a ratcheting direction for the ratchet utilizing a direction toggle on a bottom-half portion of a handle of the ratchet (step 706). Step 706 allows the ratcheting mechanism to be engaged. The ratcheting mechanism may utilize pawls, or any number of known systems for engaging and disengaging the ratchet, that function with the rotating drum. The direction toggle may be integrated within the handle of the ratchet or on the surface of the ratchet head or handle. Next, the ratchet performs ratcheting based on user interaction (step 708). During step 708 the user may apply torque to the handle of the ratchet to attach or detach a fastener that interacts with a socket attached to the ratchet.

The described embodiments may allow a user to purchase a single ratchet tool, or set, to utilize with numerous sockets. In particular, the user may only be required to utilize female sockets in spaces that may have traditionally required wrenches, inverted socket wrenches, or other tools that may be expensive or inconvenient for the task at hand. As a result, the enhanced ratchet may allow a user to more conveniently work in spaces and to save money on tools required to accomplish specific tasks.

The previous detailed description is of a small number of embodiments for implementing the invention and is not intended to be limiting in scope. The following claims set forth a number of the embodiments of the invention disclosed with greater particularity.

What is claimed:

1. A ratchet, comprising:

a handle;

a head connected to the handle;

a rotating drum rotationally mounted within the head, a top edge of the rotating drum being open, a bottom edge of the rotating drum being closed by a surface, a rotating head extends from the surface of the rotating drum, a pair of pawls within the head interact with the rotating drum to drive the rotating drum and the rotating head in a first direction or a second direction in response to a force being applied to the handle; and a direction toggle connected to the pair of pawls by a pair of linkages retractable substantially parallel to the handle, wherein one of the linkages is connected to a first pawl of the pair of pawls and the other linkage is connected to a second pawl of the pair of pawls, the direction toggle being operable to engage the pair of pawls for selecting to drive the rotating head of the rotating drum in the first direction, the second direction, or neither direction corresponding to a first position, a second position, and a third position of the direction toggle, respectively.

2. The ratchet of claim 1, wherein an outer surface of the rotating drum is covered by teeth, wherein the pair of pawls impinge upon the teeth to drive the rotating drum in the first direction or the second direction, and wherein the rotating drum is recessed within the head.

3. The ratchet of claim 2, wherein a first end of the handle connects the head, the direction toggle extends from a second end of the handle for allowing a user to select the first position or the second position, wherein the pair of linkages connect the direction toggle to the pair of pawls through the handle.

4. The ratchet of claim 1, further comprising:

a fastener extending from within the rotating head for securing a female socket; and a release in communication with the fastener, the release allowing a female socket to be attached to or removed from the rotating head.

5. The ratchet of claim 1, wherein the first pawl and the second pawl are pivotally mounted within the head, the pair of pawls are connected to the direction toggle, the first pawl drives rotation of the rotating drum in the first direction when the direction toggle is positioned in the first position, the second pawl drives rotation of the teeth of the rotating drum in the second direction when the direction toggle is in the second position.

6. The ratchet according to claim 5, wherein the first pawl and the second pawl impinge upon the teeth of the rotating drum to drive the rotating head in the first direction or the second direction.

7. The ratchet according to claim 1, wherein a female socket is seated substantially within the rotating drum when the female socket is attached to the rotating head for attaching or detaching a fastener.

8. The ratchet according to claim 1, wherein torque of the rotating head drives a female socket, and the surface supports a bottom portion of the female socket.

9. The ratchet according to claim 1, further comprising:

a bearing assembly within the head rotationally supporting the rotating drum.

10. The ratchet according to claim 1, wherein the ratchet is integrated in a screw driver or pneumatic tool.

11. An enhanced ratchet, comprising:

a handle;

a head connected to the handle;

a rotating drum rotationally mounted with the head, an outer surface of the rotating drum being covered by teeth, a top edge of the rotating drum being open, a bottom edge of the rotating drum being closed by a surface, a rotating head is integrated with the surface of the rotating drum, wherein a socket is substantially seated in the rotating drum when attached to the rotating head; and a direction toggle accessible at an end of the handle, the direction toggle operably connected to a first pawl and a second pawl through a pair of linkages extending through the handle, one of the linkages connected to the first pawl and another of the linkages connected to the second pawl, the first and the second pawl being operable to engage the teeth for driving the rotary head of the rotating drum in a first mode, a second mode, or a third mode, corresponding to a first position, second position, and third position of the direction toggle.

12. The ratchet according to claim 11, wherein in the first position the first pawl impinges upon the teeth of the rotating drum to drive the rotating head in a first direction when a force is applied to the handle, wherein in the second position the second pawl impinges upon the teeth of the rotating drum to drive the rotating head in a second direction when a force is applied to the handle, and wherein in the third position the first pawl and second pawl impinge upon the teeth of the rotating drum to drive the rotating head in the first direction and the second direction when the force is applied to the handle.

13. The ratchet according to claim 11, wherein the socket is a female socket, wherein the ratchet and the female socket have a decreased width when compared with a traditional ratchet and the female socket.

14. The enhanced ratchet according to claim 11, wherein the enhanced ratchet is integrated with a power tool.

15. The enhanced ratchet according to claim 11, wherein the enhanced ratchet is integrated with a screw driver.

16. A method for utilizing an enhanced ratchet comprising:

receiving a socket within a rotating drum of the enhanced ratchet, the socket being secured to a rotating head attached to the rotating drum, the socket being seated substantially within a ratchet head of the enhanced ratchet rotationally securing the rotating drum;

receiving positioning of a direction toggle corresponding to one of three modes, the first mode corresponding to a clockwise driving force and a counter-clockwise ratcheting direction, the second mode corresponding to a counter-clockwise driving force and a clockwise ratcheting direction, and the third mode corresponding to the clockwise driving force and the counterclockwise driving force, the direction toggle being connected to a pair of retractable linkages wherein one linkage is connected to a first pawl of a pair of pawls and the other linkage is connected to a second pawl of the pair of pawls for selecting one of the three modes; and applying a driving force to the socket in response to receiving the positioning of the direction toggle in one of the three modes.

17. The method according to claim 16, further comprising:

receiving user input to a fastener to disengage a release allowing the socket to be attached to or removed from the rotating head.

18. The method according to claim 17, wherein the fastener is integrated with the direction toggle.

19. The method according to claim 16, wherein the socket is a female socket substantially seated within the rotating drum.

20. The method according to claim 16, wherein the rotating drum is driven in the three modes by the pair of pawls engaged therewith in response to the position of the direction toggle.

21. The method according to claim 16, wherein the pair of retractable linkages are positioned in a handle connected to the ratchet head, rotation of the direction toggle to a first position being operable to retract one of the retractable linkages substantially parallel to the handle, and rotation of the direction toggle to a second position being operable to retract another of the retractable linkages substantially parallel to the handle.

* * * * *